US006648347B1

(12) United States Patent
Rieg

(10) Patent No.: US 6,648,347 B1
(45) Date of Patent: Nov. 18, 2003

(54) TWO-PIECE SNOWBOARD FOR CONTROLLED MOVEMENT ON SNOW OR OTHER GLIDABLE MEDIA

(76) Inventor: Wolfgang Rieg, Ernst-Heinkel-Str. 47, D-71404 Korb (DE)

( * ) Notice: Subject to any disclaimer, the term of this patent is extended or adjusted under 35 U.S.C. 154(b) by 0 days.

(21) Appl. No.: 09/869,890

(22) PCT Filed: Jan. 4, 2000

(86) PCT No.: PCT/DE00/00095

§ 371 (c)(1),
(2), (4) Date: Oct. 9, 2001

(87) PCT Pub. No.: WO00/40311

PCT Pub. Date: Jul. 13, 2000

(30) Foreign Application Priority Data

Jan. 7, 1999 (DE) ..... 199 00 225
Dec. 31, 1999 (DE) ..... 199 63 965

(51) Int. Cl.[7] ..... A63C 5/02
(52) U.S. Cl. ..... 280/14.25; 280/818
(58) Field of Search ..... 280/603, 609, 280/11.14, 11.15, 817, 818, 14.21, 14.25, 15, 17, 28.16

(56) References Cited

U.S. PATENT DOCUMENTS 4,161,324 A * 7/1979 Colvin ..... 280/14.25
4,221,394 A * 9/1980 Campbell ..... 280/14.25
4,817,988 A * 4/1989 Chauvet et al. ..... 280/817
5,531,480 A * 7/1996 Foertsch ..... 280/818
5,613,695 A * 3/1997 Yu ..... 280/14.25
5,618,051 A 4/1997 Kobylenski
5,799,956 A * 9/1998 Shannon ..... 280/14.21
6,053,513 A * 4/2000 Dickinson ..... 280/14.21
6,113,115 A * 9/2000 Hurth ..... 280/15
6,270,091 B1 * 8/2001 Smith ..... 280/14.21

FOREIGN PATENT DOCUMENTS

DE 93 15 355 2/1994
DE 196 28 248 1/1998
FR 2665642 * 2/1992 ..... 280/15
FR 2739297 4/1997

* cited by examiner

*Primary Examiner*—Frank Vanaman
(74) *Attorney, Agent, or Firm*—Kenyon & Kenyon

(57) ABSTRACT

A two-piece snowboard for controlled movement on snow and other media for gliding, comprising front and rear gliding members having binding devices for holding feet. A connecting device couples the front and rear gliding members. The connective device includes first and second connecting elements connected to one of the gliding members. In various embodiments at least one of the first and second connecting elements is rigid, and the further connecting element is able to rotate in at least one plane. Additionally, or alternatively, at least one of the first and second connecting elements includes at least two bearing elements. The bearing elements provide for movement about the horizontal axis transverse to a direction of travel and/or movement about the vertical axes of the bearing elements, and also provide for connection to the gliding members. The first and second connecting elements and the bearing elements are provided with a restoring torque.

5 Claims, 14 Drawing Sheets

TWO-PIECE SNOWBOARD FOR CONTROLLED MOVEMENT ON SNOW OR OTHER GLIDABLE MEDIA

FIELD OF THE INVENTION

The present invention relates to a two-piece snowboard.

BACKGROUND INFORMATION

A conventional two-piece snow board is described in German Published Patent Application No. 196 28 248. In this case, two gliding members are interconnected by an articulated linkage, which allows a flexible joint to rotate relatively to each gliding member, about a transverse axis parallel to the center axis. However, this snowboard only allows one to glide on snow to a very limited extent, since the two gliding members can move uncontrollably in the joints while riding.

German Patent No. 93 15 355 also describes a two-piece snowboard, which have individual gliding members joined by a connecting rod. The joints at the end of the connecting rod are attached in the space between the raised footprints for the user and the gliding members. The joints can freely pivot 360°, which results in high forces occurring while riding, rendering the two-piece snowboard unridable as well. In addition, the raised standing position of the user leads to a strong feeling of imbalance, due to shifting the center of gravity upwards. This situation is also not beneficial for riding in a controlled manner.

U.S. Pat. No. 5,618,051 describes two gliding members, which are joined to different rubber belts, bands, or similar connecting elements. The elastically designed connecting devices do not ensure that the selected distance between the gliding members for riding in a controlled manner is maintained. Such a device cannot be controlled purely by the muscle power of the user.

French Published Patent Application No. 27 39 297 describes a possibility for connecting mini skis, using one or more torsion rods or a rubber bearing between the rear end of the first mini ski and the front end of the second mini ski. In this context, the torsion rods are rigid or adjustable in the longitudinal direction with the ski elements, but are not connected to them by joints. Connecting the ski elements using a rubber bearing allows the front mini ski to rotate with respect to the rear mini ski, but does not allow the ski elements to move parallel to each other, which is useful for controlled cornering.

SUMMARY OF THE INVENTION

The present invention provides the two-piece snowboard that may be controlled and inspected very easily. The snowboard is not exclusively controlled by the user shifting his or her body weight, but rather by the user rotating his or her legs. The possibility of controlling the snowboard to an exact degree allows the direction to be changed in a controlled manner, the ability of the user to balance not playing a crucial part in changing direction. In addition, the present invention provides a two-piece snowboard, which is provided with a snowboard-element connecting device in which restoring torques are integrated in joint elements, which are optimally and individually adapted to the specific riding situation, by means of quick adjustment, for all speed ranges in which the two-piece snowboard is moved. That is, the overall handling of the two-piece snowboard can be adjusted to be very stiff for fast downhill runs, and the joint elements can be adjusted loosely for turning at a tight curve radius. Two different quick adjustments are possible here. The first adjustment option exists at the main joint element, which can absorb torsion, bending, and compressive forces in three planes, and whose stiffness can be adjusted by a hand-operated knob. The second adjustment option exists in the region of the connecting lever of the connecting device. The range of motion and the restoring torque of the connecting lever in the horizontal plane can also be adjusted very quickly by a hand-operated knob, and can be adapted to the specific riding situations. The two possibilities for adjustment go so far, that the joints can reach their maximum available travel, and a rigid connection can be created between the gliding members and the connecting lever. The connecting device is then in the form of a rigid connection between the gliding members. The present invention also provides for devices, which are similar to bindings and bind the user to the board, to be integrated into the connecting device for the two snowboard elements. In this context, these binding-like devices can be designed for soft boots or for ski boots. It is crucial that both the binding-like device and the connecting device be jointly fastened to the snowboard. This yields efficiencies with regard to manufacturing. The necessary adjustments regarding different crotch measurements of persons of different size can be made economically, using a length adjustment device in the region of the connecting lever or fastening elements.

In addition, the present invention allows one to move on flat terrain by wriggling the front and rear parts of the snowboard relatively to each other. A change of direction is even easier to control, i.e. more easily possible, when one is almost at rest or traveling uphill. Furthermore, the present invention allows the curve radius of the ridden curve to be controlled and changed at all times, without having to apply compression pressure to the snowboard end. The present invention can be disassembled very quickly for using a ski lift, so that each of the two snowboard parts remains on one foot of the user while riding the lift. This allows one to ride the lift decidedly more easily in comparison with conventional snowboards. If the user does not wish to separate the two halves of the ski, the present invention facilitates riding the ski lift by improving the ability to balance. In the same manner, the present invention can be quickly disassembled after use, into two or more parts, and can therefore be transported easily.

DETAILED DESCRIPTION

Figure 1:
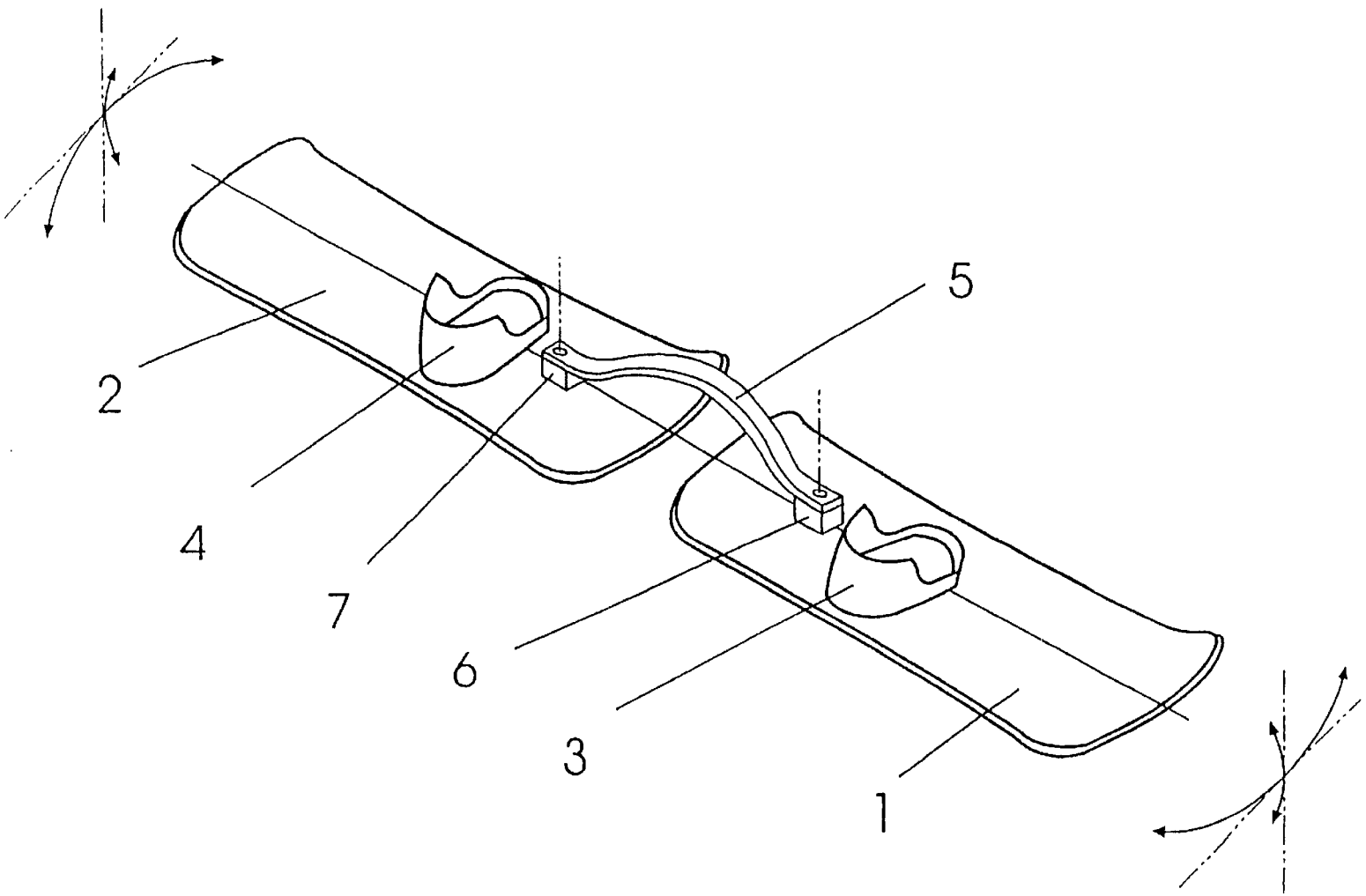
FIG. 1 shows an exemplary embodiment of the two-piece snowboard according to the present invention having an exemplary connecting rod assembly that is connected to gliding members by exemplary connecting elements.

FIG. 1 shows an exemplary embodiment, where the two gliding members 1, 2 to which binding-like devices 3, 4 are attached are connected by a connecting rod assembly 5 and connecting elements 6, 7. Connecting elements 6, 7 are fastened to gliding members 1, 2 on one side, and to the two ends of connecting rod assembly 5 on the other side. Connecting elements 6, 7 can be designed in a variety of ways. For example, the connecting elements 6, 7 can be designed as ball-head joints, which enable connecting rod assembly 5 to move relatively to gliding member 1, 2, about both the vertical axis and the horizontal axis of connecting elements 6, 7. In addition, one or two of the connecting elements 6, 7 can be designed so as to only allow a movement about the horizontal axis. Furthermore, connecting elements 6, 7 can be designed so as to permit connecting rod assembly 5 to move only relatively to gliding members 1, 2, in a manner limited by the angle of rotation.

Figure 2:
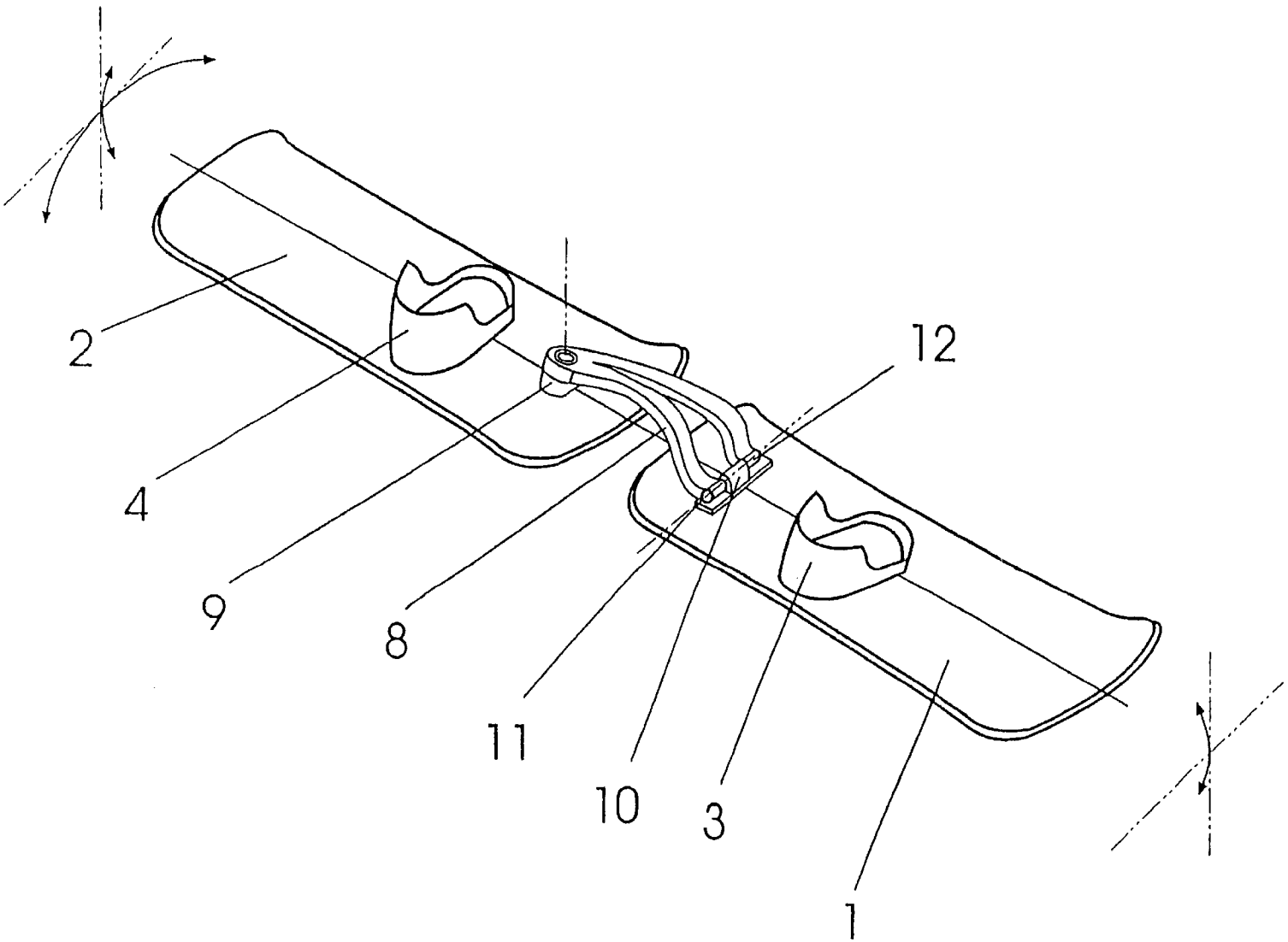
FIG. 2 shows another exemplary embodiment of the two-piece snowboard according to the present invention having an exemplary connecting device that is connected to gliding members by exemplary connecting elements and bearing elements.

FIG. 2 shows an exemplary embodiment, where the two gliding members 1, 2 to which binding-like devices 3, 4 are attached are joined by a connecting device 8 and connecting elements 9, 10. Connecting elements 9, 10 are fastened to gliding members 1, 2 on one side, and to the ends of connecting device 8 on the other side. Connecting element 9 can be designed in a variety of ways. For example, connecting element 9 can be designed as a ball-head joint, so that connecting device 8 can move relatively to either gliding member 1 or gliding member 2 about both the vertical axis and the horizontal axis of connecting element 9. In addition, connecting element 9 can be designed so as to only allow a movement about the horizontal axis. Furthermore, connecting element 9 can be designed so as to only allow connecting device to move relatively to gliding member 1 or gliding member 2, in a manner limited by the angle of rotation. Connecting element 10 is designed so as to be joined to connecting device 8 by two bearing elements 11, 12, in a hinge-like manner. In this context, it is possible for connecting device 8 to rotate about the horizontal axis of the bearing elements, transversely to the direction of travel. This enables gliding member 2 to move upwards and downwards with respect to gliding member 1. In this context, bearing elements 11, 12 can be developed as freely rotatable bearings or as automatically resetting bearings, which only allow a limited angular motion.

Figure 3:
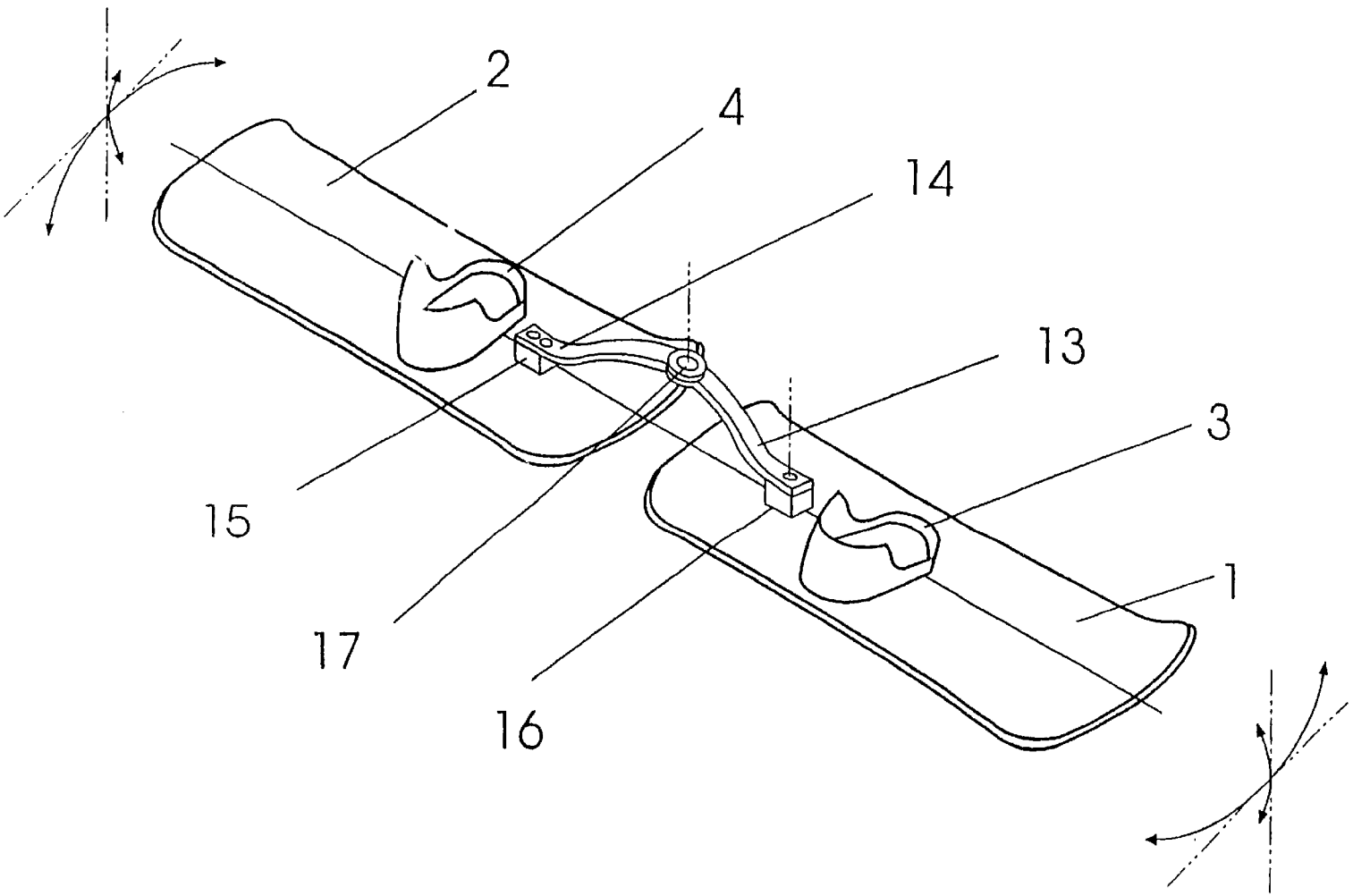
FIG. 3 shows another exemplary embodiment of the two-piece snowboard according to the present invention having an exemplary connecting rod assembly having two parts joined by an exemplary connecting element (17), the two parts being joined to gliding members by exemplarily represented, connecting elements or fixed bearings.

FIG. 3 shows an exemplary embodiment, where the two gliding members 1, 2 to which binding-like devices 3, 4 are attached are connected by a three-piece connecting rod. The connecting rod includes a front part 13, a rear part 14, and a connecting element 17 between front part 13 and rear part 14. In this case, connecting element 17 is designed as a joint. This allows an angular motion between the rear part 14 and the front part 13 of the connecting rod, the rotational angle of the angular motion being limitable by end stops not described in further detail. It is also possible to design connecting element 17 so that, apart from the angular motion in the horizontal plane, i.e. about the vertical axis of the joint, front part 13 of the connecting rod can also move with respect to rear part 14 of the connecting rod, about the transverse horizontal axis of the joint. For example, such a motion is rendered possible by the use of rubber bearings in the region of the joint. In this context, connecting elements 15, 16 can be designed in such a manner, that a rigid connection exists between gliding members 1, 2 and the two parts of connecting rod 13, 14, or that, alternatively, one connecting element 15 is designed to be rigid and the other connecting element 16 is designed as a joint, which allows front part (13) of the connecting rod to rotate with respect to gliding member 1 in at least one plane.

Figure 4:
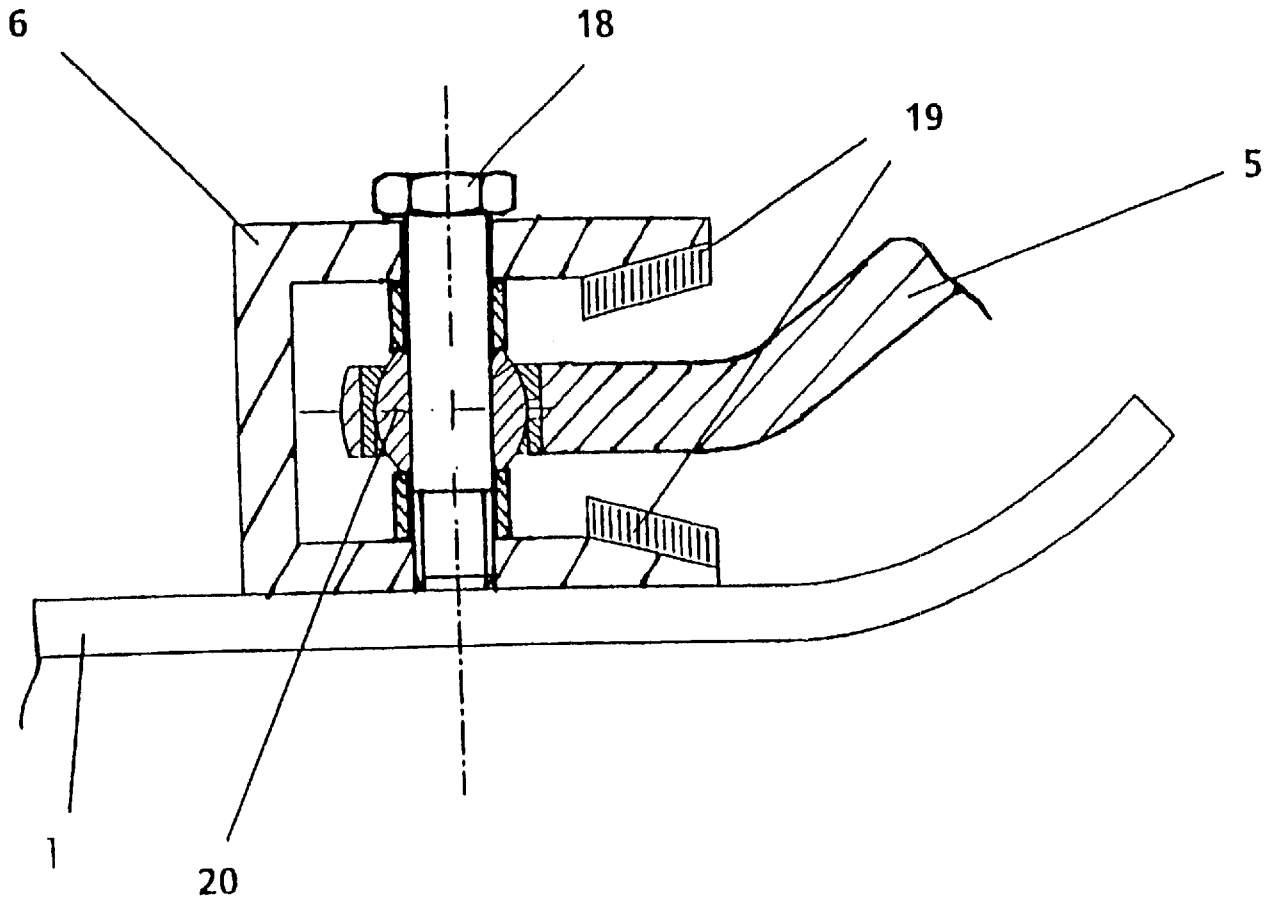
FIG. 4 shows a longitudinal cross-section of an exemplary implementation of the connecting elements shown in FIG. 1, FIG. 2, and FIG. 3.

FIG. 4 shows a longitudinal section of an addition to the exemplary embodiment from FIGS. 1, 2, and 3. Connecting element 6, which is represented by way of example, is rigidly connected 10 to gliding member 1 in a manner not described in detail. Bearing fastener 18 and limit stops 19, which limit the angular motion of connecting rod assembly 5 in both the vertical and horizontal directions, are integrated in the housing of connecting element 6. The ends of connecting rod assembly 5 are designed as ball-joint bearings 20, which have a through-hole. Bearing fastener 18 joins connecting rod assembly 5 to the housing of connecting element 6, via the through-hole of ball-joint bearing 20. The described design of connecting element 6 can also apply to the other connecting elements 7, 9, 15, 16 described in FIG. 1, FIG. 2, and FIG. 3.

Figure 5:
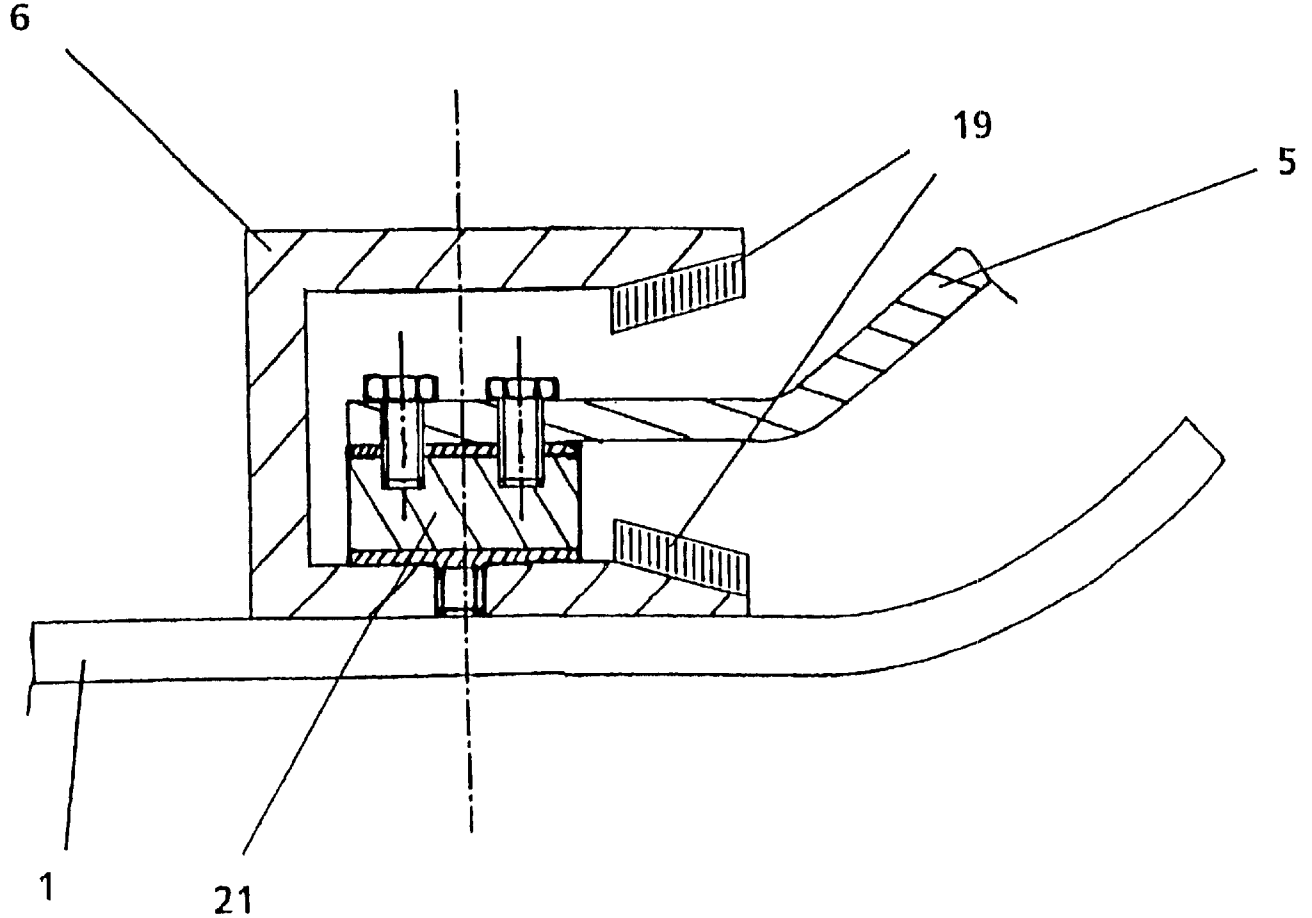
FIG. 5 shows a longitudinal cross-section of another implementation of the connecting elements.

FIG. 5 shows a longitudinal section of an addition to the exemplary embodiment from FIGS. 1 and 2. Connecting element 6, which is represented by way of example, is rigidly connected to gliding member 1 in a manner not described in detail. Limit stops 19, which limit the angular motion of connecting rod assembly 5 in both the vertical and horizontal directions, are integrated in the housing of connecting element 6. In addition, the joint designed as a bearing pad 21 is integrated in the housing of connecting element 6. The ends of connecting rod assembly 5 are rigidly connected to bearing pad 21. Bearing pad 21 has a conventional design, i.e. a rubber bearing is provided with metal plates, which are vulcanized to its upper side and lower side, and to which threaded rods are attached. The connection to the housing of connecting element 6 and connecting rod assembly 5 is accomplished by a screw joint or another quick-release connection. The use of bearing pads 21 as a joint element only allows a limited angular motion to take place, and allows the bearing to be returned to its starting position automatically. The described design of connecting element 6 can also be applied to any of the other connecting elements 7, 9, 15, 16. The hardness, elasticity and service life of the bearing pads may be varied by including different physical properties in the bearing pads.

Figure 6:
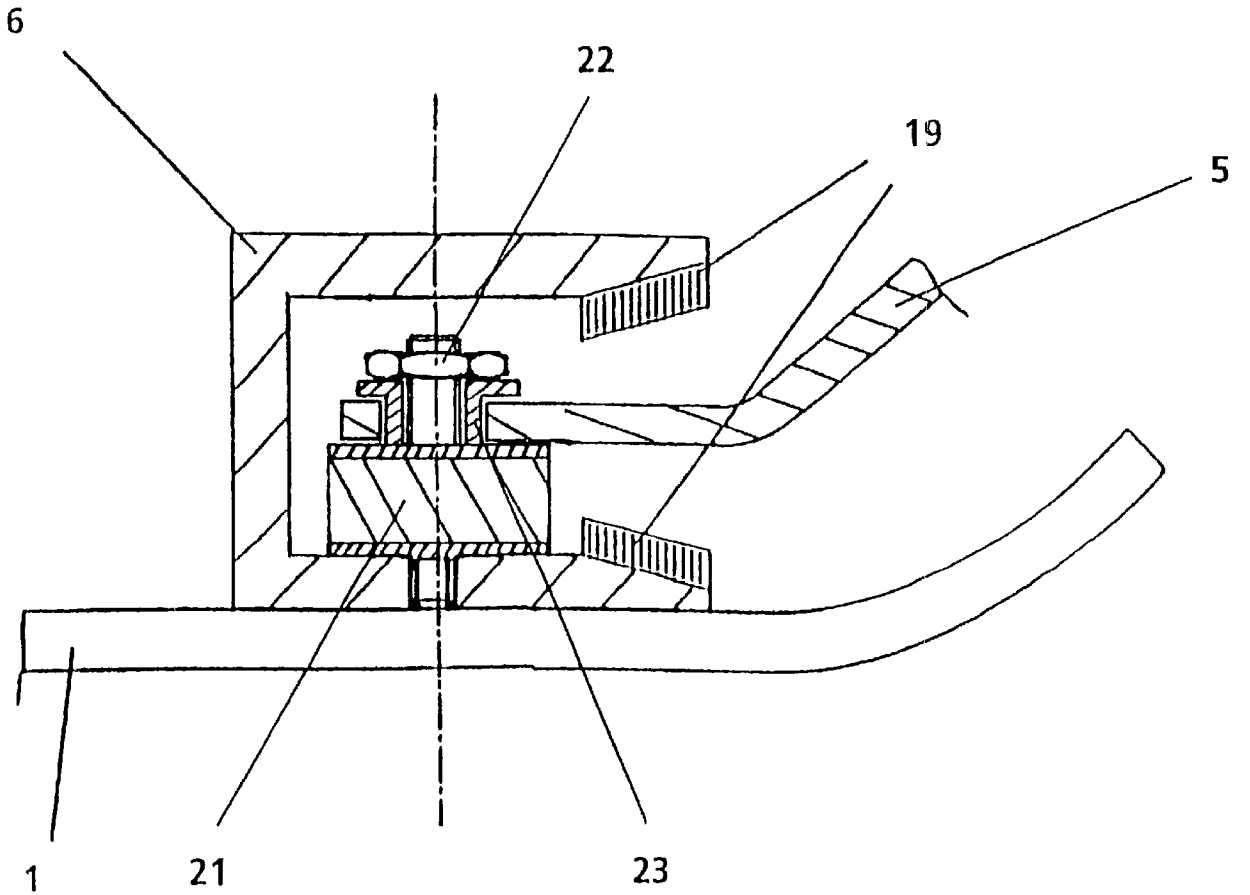
FIG. 6 shows a longitudinal cross-section of a further implementation of the connecting elements.

FIG. 6 shows a longitudinal section of a variant for the exemplary embodiments shown in FIG. 4 and FIG. 5. In this case, connecting rod assembly 5 is joined to connecting element 6 via bearing element 21, 22, 23. The bearing element includes a bearing pad 21, which enables gliding members 1, 2 to move relatively to each other, about the transverse horizontal axis. The lower end of bearing pad 21 is joined to connecting element 6. At the free, upper end of bearing pad 21, a bearing sleeve 23 is placed between the threaded rod of bearing pad 21 and the connecting rod assembly 5, and is secured by bearing cover 22 in such a manner, that connecting rod assembly 5 can rotate freely about the vertical axis of the bearing. The combination of a joint that can freely rotate about the vertical bearing axis, and a bearing pad 21 in the form of a joint element for movement about the transverse horizontal axis, allows, on one hand, only limited rotation about the tranverse horizontal axis and the automatic restoration of the bearing to its starting position, and on the other hand, unrestricted movement about the vertical axis of the bearing. The described design of connecting element 6 can also apply to any of the other connecting elements 7, 9, 15, or 16.

Figure 7:
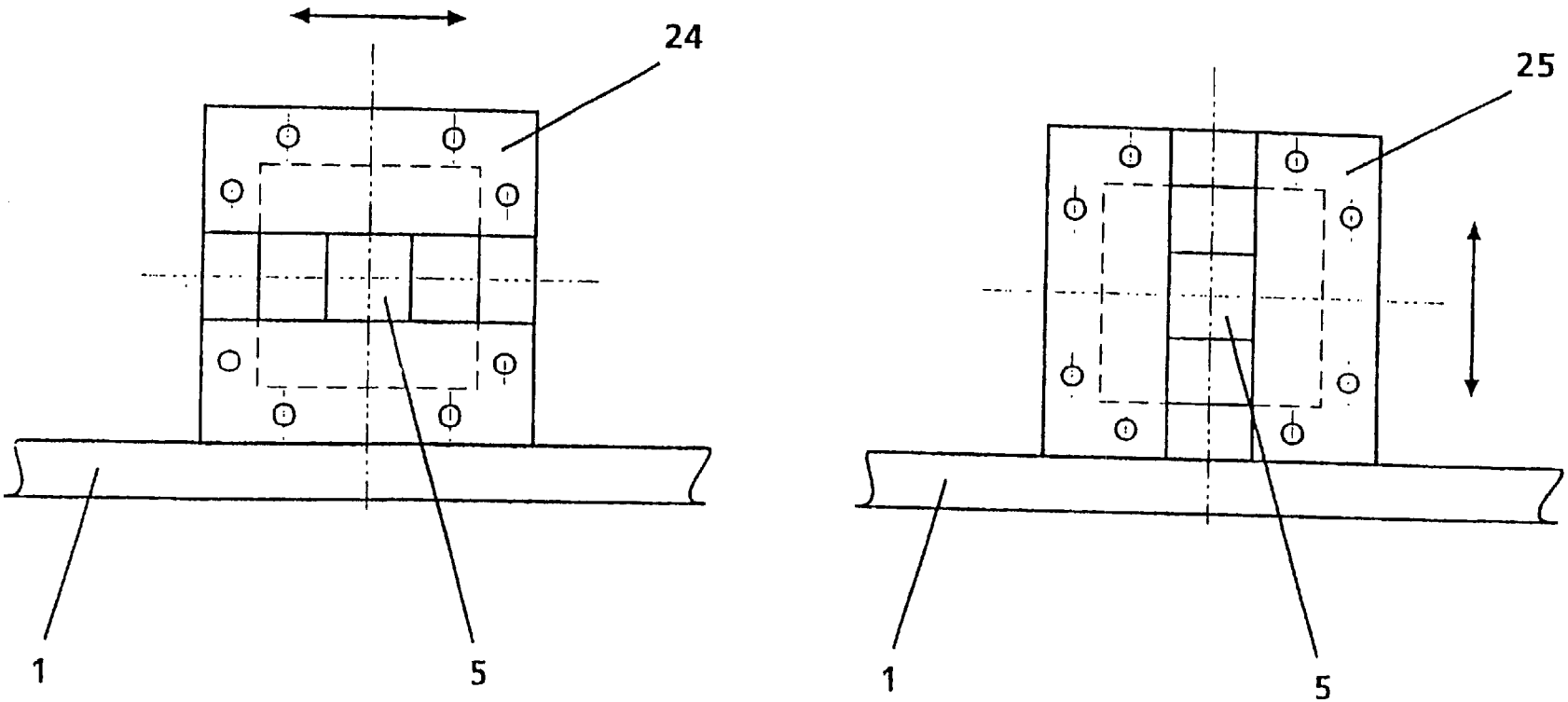
FIG. 7 shows an exemplary embodiment of a locking arrangement for the connecting elements shown in FIGS. 4, 5 and 6. A front view of a connecting element is represented.

FIG. 7 shows a front view of an addition to the exemplary embodiment from FIGS. 4, 5, and 6. An exemplary locking element 24, 25 is represented which, by means of a rigid, but quickly releasable connection to connecting element 6, limits the freedom of motion of connecting rod assembly 5 in such a manner, that connecting rod assembly 5 can only move relatively to gliding member 1, about the vertical rotational axis of the joint, or about the transverse horizontal axis. This locking element 24, 25 can be subsequently attached to connecting element 6 by inserting it, so that the function of the joints can be changed within a short period of time. Locking element 24, 25 is designed in such a manner, that one element can optionally eliminate both types of rotational motion. Locking element 24, 25 can be further developed so as to allow no more angular motion, and produce a rigid connection between connecting rod assembly 5 and gliding member 1.

Figure 8:
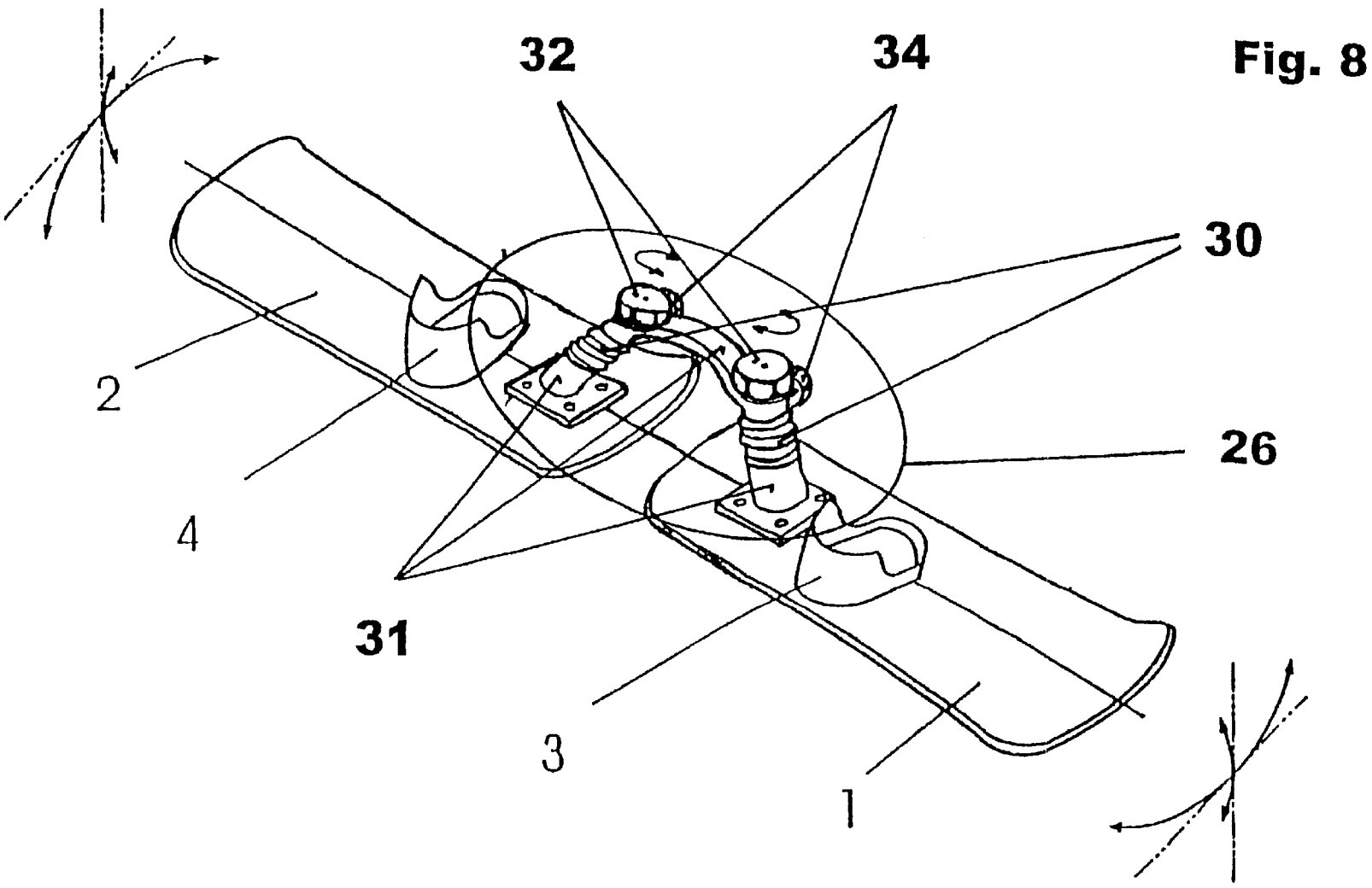
FIG. 8 shows an exemplary embodiment of the two-piece snowboard according to the present invention having an exemplary connecting device which interconnects the gliding members.

FIG. 8 shows an exemplary embodiment in which the two gliding members 1, 2, to which binding-like devices 3, 4 are attached, are interconnected by a connecting device 26. Connecting device 26 is made of connecting rod assembly 31 and two adjustable joint elements 30. The stiffness of each joint element 30 can be quickly adjusted, using two hand-operated knobs 32, 34, respectively. In this context, joint elements 30 can be adjusted continuously or in steps, using hand-operated knobs 32, 34.

Figure 9:
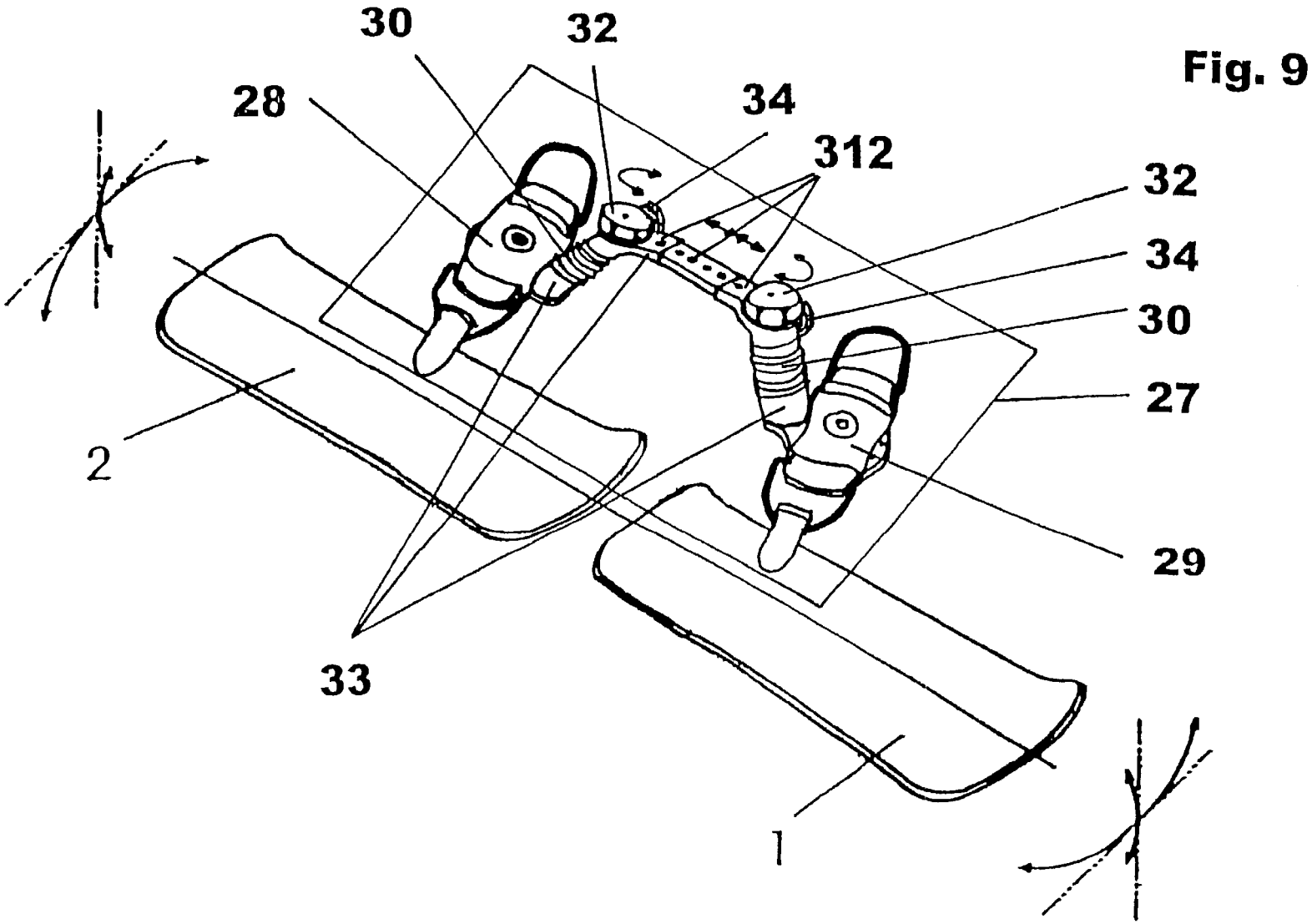
FIG. 9 shows an exemplary embodiment of the two-piece snowboard according to the present invention having an exemplary connecting device which includes integrated, binding devices that interconnect the gliding members.

FIG. 9 shows an exemplary embodiment in which the two gliding members 1, 2 are interconnected by a connecting device 27. Binding devices 28, 29 are integrated at the front and rear ends of connecting device 27, and the entire device is fastened to gliding members 1, 2. In order to adjust the standing width to the measurements of different users, one can adjust the length in the middle region of connecting rod assembly 33. As in the design of FIG. 1, the stiffness of each joint element 30 can be quickly adjusted, using two hand-operated knobs 32, 34. In this context, joint elements 30 can be adjusted continuously or in steps, using hand-operated knobs 32, 34.

Figure 10:
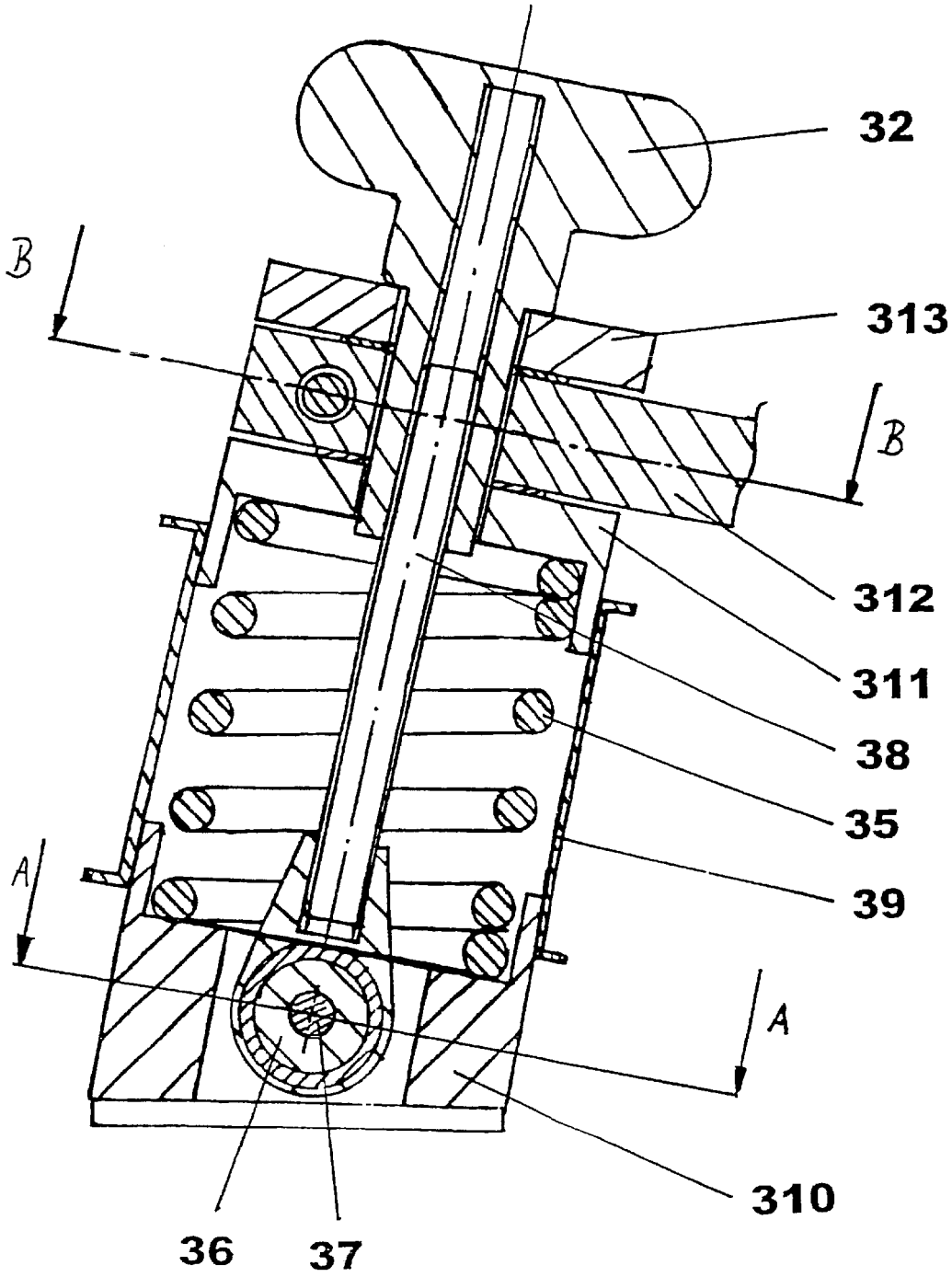
FIG. 10 shows a longitudinal cross-section of an exemplary embodiment of the connecting device. An adjustable joint element of connecting device for attachment to the gliding members is illustrated.

FIG. 10 shows a longitudinal cross-section of an exemplary embodiment of connecting device 26. Represented is an adjustable joint element 30 of connecting device 26 for attachment to gliding members 1, 2. Connecting rod assembly 31 from FIG. 8 is made up of the component parts bearing block 310, spring receptacle 311, lever 312, and cover 313. Joint element 30 is made up of the component parts spring 35, ball-joint head 36, bolt 37, threaded rod 38, and rubber sleeve 39. Bearing block 310 is connected to gliding member 1, 2, and forms the lower part of connecting rod assembly 31. In bearing block 310, ball-joint head 36 and the end of spring 35 are secured in place by a screw 37. In this case, bearing block 310 is designed to allow movement of ball-joint head 36. The receptacle for fixing spring 35 in place is integrated in bearing block 310. Ball-joint head 36 is permanently connected to a threaded rod 38. To economize on space, threaded rod 38 is situated in the interior space of spring 35. Hand-operated knob 32 is screwed onto the top end of threaded rod 38. Spring 35 is enclosed by bearing block 310 and spring receptacle 311. Cover 313 and spring receptacle 311 form the bearing housing for lever 312, which is pivoted at hand-operated knob 32. The arrangement of hand-operated knob 32, which is free to rotate in the bearing housing made up of cover 313 and spring receptacle 311, allows spring 35 to be prestressed. The spring constant of spring 35 can be changed by turning hand-operated knob 32, which brings bearing block 310 and spring receptacle 311 together or separates them. When brought together completely, spring 35 reaches its maximum available travel, i.e. bearing block 310 and spring receptacle 311 are rigidly connected. The spring constant can be continuously adjusted by separating bearing block 310 and spring receptacle 311. By securing it on both ends, spring 35 is designed as both a torsion, compression, and spiral spring. This arrangement creates an adjustable bearing element. Rubber sleeve 39 prevents dirt or snow from impairing the function of the joint element.

Figure 11:
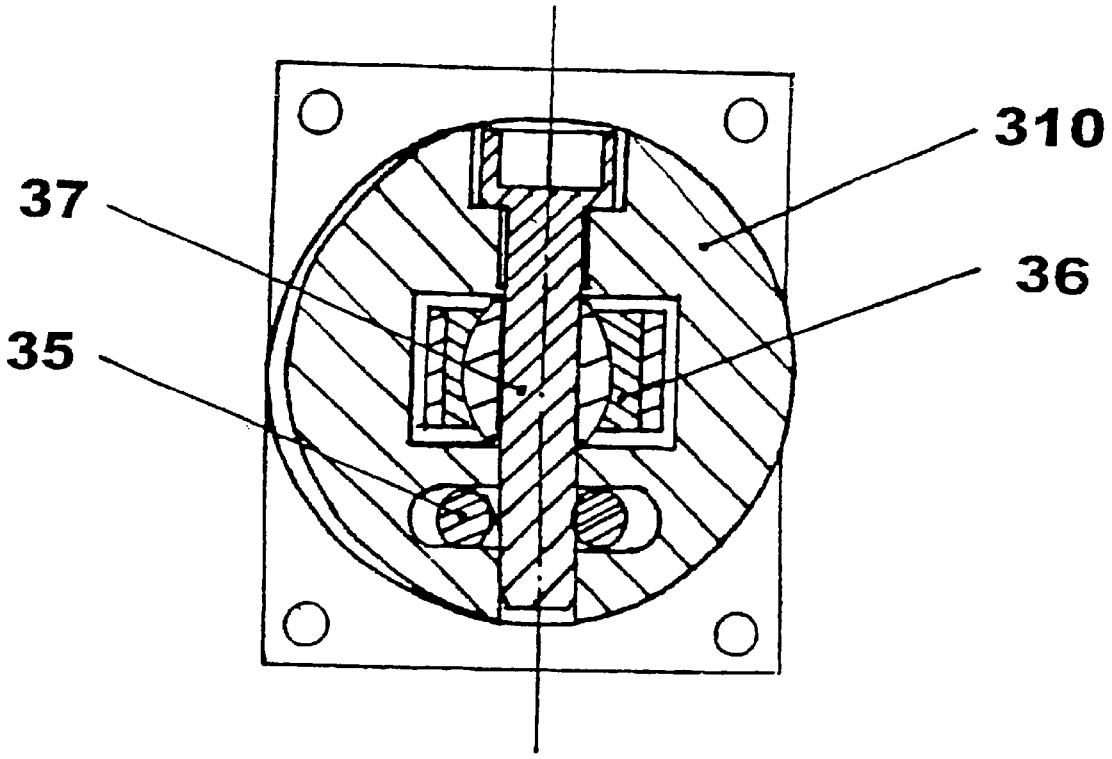
FIG. 11 shows a section along line A—A of FIG. 10 of a bearing block of the connecting rod assembly.

FIG. 11 shows an exemplary embodiment as an addition to FIG. 10. A section A—A through bearing block 310 of connecting rod assembly 31 is represented. In bearing block 310, ball-joint head 36 and the lower end of spring 35 are secured in place by a screw 37.

Figure 12:
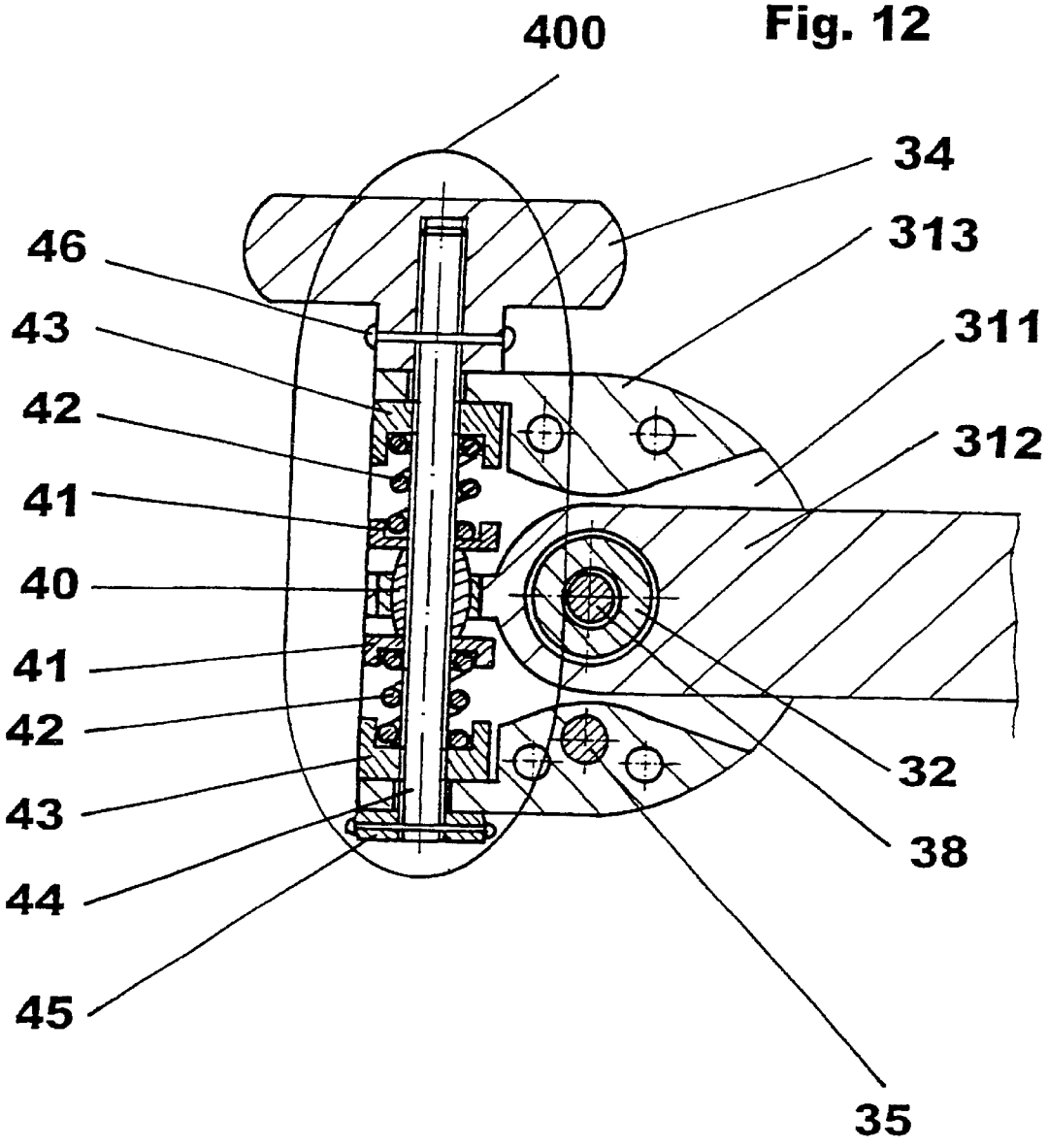
FIG. 12 shows a section along line B—B of FIG. 10 illustrating a cover of the connecting rod assembly, as well as a damping adjustment device for the lever.
Figure 13:
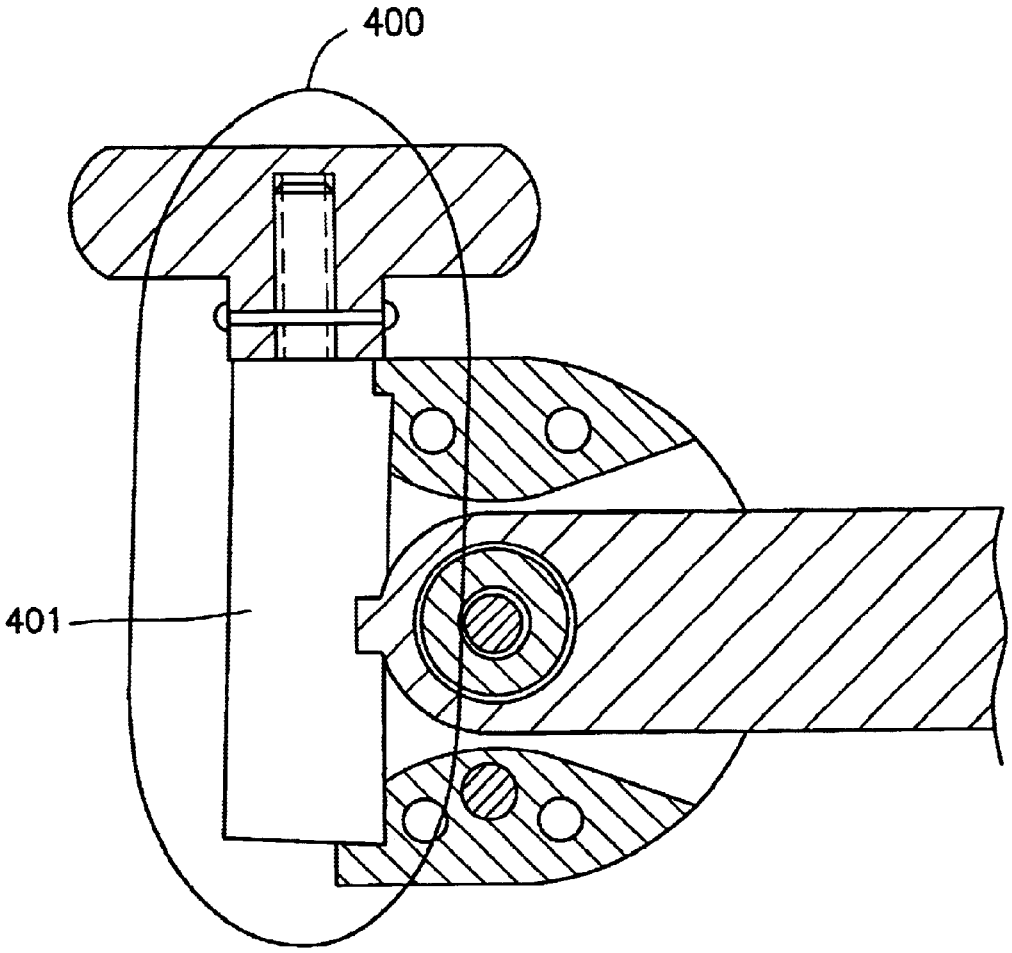
FIG. 13 shows a electric adjusting device.
Figure 14:
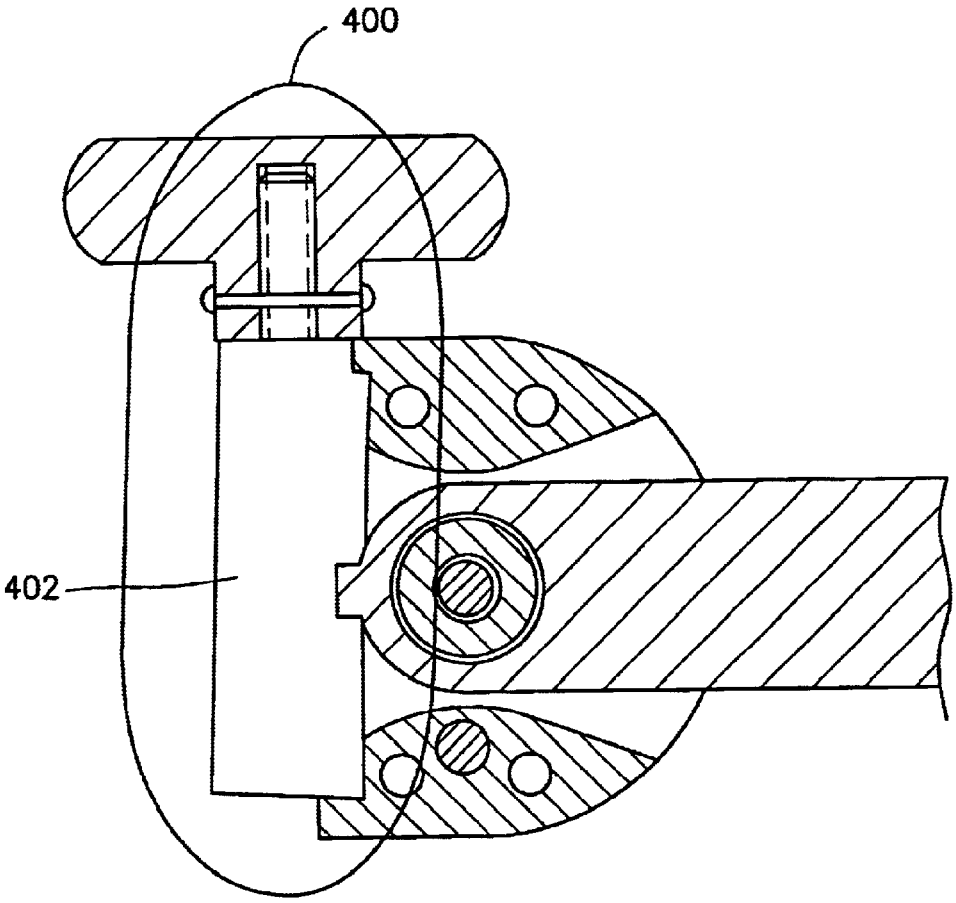
FIG. 14 shows a pneumatic adjusting device.

FIG. 12 shows an exemplary embodiment as an addition to FIG. 10. Represented is a section B—B through cover 313 of connecting rod assembly 31, and through damping adjustment device 400 for lever 312. Lever 312 is pivoted at hand-operated knob 32, which is connected to threaded rod 38. Cover 313 is screwed to spring receptacle 311. The free upper end of spring 35 is fixed in position in cover 313. On the right side, cover 313 is provided with a rigid limit stop, which is above the level of lever 312 and is in the form of a maximum limit stop for lever 312, and on the left side, the cover is provided with an adjustable limit stop and damping adjustment device 400. Damping adjustment device 400 includes the component parts ball-joint head 40, spring receptacles 41, springs 42, threaded spring receptacles 43, threaded rod 44, securing nut 45, hand-operated knob 34, and cotter pin 46. Ball-head joint 40 is integrated in the free end of lever 312. Threaded rod 44, which is provided with a right-hand thread over one half of its length and a left-hand thread over the other half of its length, is freely pivoted in cover 313. Hand-operated knob 34 is screwed onto one end of threaded rod 44, and cotter pin 46 prevents it from rotating relatively to threaded rod 44. A securing nut 45, which is also prevented from rotating relatively to threaded rod 44, is screwed onto the other end of threaded rod 44. Spring elements made of spring receptacle 41, spring 42, and threaded spring receptacle 43 are situated on the respective sides, between ball-head joint 40 of lever 312, and cover 313. Threaded spring receptacles 43 are either provided with a left-hand thread or a right-hand thread, and are screwed onto threaded rod 44. By turning hand-operated knob 34, threaded spring receptacles 43 are moved inwards or outwards, so that springs 42 are compressed or relieved. In this manner, the initial stress in the springs can be adjusted, depending on the need and the riding situation. It is also possible to completely lock lever 312, so that it cannot rotate any more. This creates a rigid connection between lever 312 and cover 313. The damping adjustment device may include a combination of spring-damper units and adjustment of the damping adjustment device may be performed by a manual, electric or pneumatic adjusting device. Additionally, all connecting devices for the embodiments illustrated may be manufactured of at least one of aluminum, steel and plastic. FIG. 13 illustrates an embodiment of the adjusting device with an electric adjusting arrangement 401. FIG. 14 illustrates an embodiment of the adjusting device with a pneumatic adjusting arrangement 402.

What is claimed is:

1. A two-piece snowboard for controlled movement on snow and other media for gliding, the two-piece snowboard comprising:

a front gliding member coupled to a front binding device for binding a front foot of a user to an upper surface of the front gliding member;

a rear gliding member coupled to a rear binding device for binding a back foot of the user to an upper surface of the rear gliding member; and a connecting device for coupling the front gliding member to the rear gliding member, the connecting device being connected to a rear region of the front gliding member and to a front region of the rear gliding member, the connecting device including a lever and at least one of a) at least one adjustable joint element; and b) a damping adjustment device the at least one of at least one adjustable joint element and a damping adjusting device movably interconnecting individual parts of the connecting device to allow movement in at least one plane and providing a restoring torque which automatically returns the front and rear gliding members into a primary longitudinal position, the at least one of at least one adjustable joint element and a damping adjusting device including an adjustment device enabling one of continuous and stepwise adjustment of a magnitude of a spring constant and a level of restoring torque; wherein at least one of the following:

i) the at least one of the at least one adjustable joint element and the damping adjustment device can be adjusted so as to render the connecting device rigid;

ii) the front binding device is integrated at a front end of the connecting device; and iii) the rear binding device is integrated at a rear end of the connecting device;

wherein the connecting device and the front binding device are fastened to the front gliding member using common fastening points and the connecting device and the rear binding device are each fastened to the rear gliding member using common fastening points, and the length of the lever is adjustable; and wherein the at least one adjustable joint element includes:

a bearing block;

a spring receptacle;

a spring having lower and upper ends and an interior space, the lower end being secured in the bearing block, and the upper end being secured in the spring receptacle;

a cover;

a dust protection sleeve; and a threaded rod situated in the interior space of the spring having lower and upper ends, the lower end of the threaded rod including a ball-joint head movably attached in the bearing block, and the upper end being screwed into a hand-operating knob, the upper end of the threaded rod being supported in a region of the connecting device in the spring receptacle and cover, such that an initial stress of the spring can be at least one of increased and decreased;

wherein the spring is enclosed by the dust protection sleeve.

2. The two-piece snowboard as recited in claim 1, wherein at least one of the at least one adjustable joint element and the damping adjustment device include a combination of spring-damper units and adjustment is performed by a manual, electric, or pneumatic adjusting device.

3. The two-piece snowboard as recited in claim 1, wherein the front and rear binding devices include fastening plates for attachment to the respective front and rear gliding members, and the connecting device includes a bearing block, the bearing block being integrated into the fastening plates.

4. The two-piece snowboard as recited in claim 1, wherein the connecting device includes at least one of aluminum, steel and plastic.

5. A two-piece snowboard for controlled movement on snow and other media for gliding, the two-piece snowboard comprising:

a front gliding member coupled to a front binding device for binding a front foot of a user to an upper surface of the front gliding member;

a rear gliding member coupled to a rear binding device for binding a back foot of the user to an upper surface of the rear gliding member; and a connecting device for coupling the front gliding member to the rear gliding member, the connecting device being connected to a rear region of the front gliding member and to a front region of the rear gliding member, the connecting device including a lever and at least one of a) at least one adjustable joint element; and b) a damping adjustment device the at least one of at least one adjustable joint element and a damping adjusting device movably interconnecting individual parts of the connecting device to allow movement in at least one plane and providing a restoring torque which automatically returns the front and rear gliding members into a primary longitudinal position, the at least one of at least one adjustable joint element and a damping adjusting device including an adjustment device enabling one of continuous and stepwise adjustment of a magnitude of a spring constant and a level of restoring torque; wherein at least one of the following:

i) the at least one of the at least one adjustable joint element and the damping adjustment device can be adjusted so as to render the connecting device rigid;

ii) the front binding device is integrated at a front end of the connecting device; and iii) the rear binding device is integrated at a rear end of the connecting device;

wherein the connecting device and the front binding device are fastened to the front gliding member using common fastening points and the connecting device and the rear binding device are each fastened to the rear gliding member using common fastening points, and the length of the lever is adjustable;

wherein the dampening adjustment device for the lever includes:

a cover;

a ball-joint head attached to the lever;

two spring receptacles;

a threaded rod having a right-hand thread over one half of it length, and a left-hand thread over the further half of its length, the threaded rod being supported in the cover a first and second group of threaded spring receptacles, the first group of threaded spring receptacles having a left-hand thread in its bore enabling the receptacles to move longitudinally on the threaded rod, the second group of threaded spring receptacles having a right-hand thread in its bore enabling the receptacles to move longitudinally on the threaded rod;

first and second springs, the first and second springs being held in the spring receptacles and the first and second groups of threaded spring receptacles, the first and second springs being situated in spaces between the cover and the ball-head joint, the springs being compressible such that a rigid connection is possible between the lever and the cover;

a securing nut coupled to the threaded rod; and a hand-operated knob coupled to the threaded rod.

* * * * *